United States Patent [19]

Barlow

[11] 4,195,941

[45] Apr. 1, 1980

[54] MARKING PEN WRITING TIP

[75] Inventor: Sidney D. Barlow, Scarsdale, N.Y.

[73] Assignee: Mark-Tex Corporation, Englewood, N.J.

[21] Appl. No.: 860,159

[22] Filed: Dec. 14, 1977

Related U.S. Application Data

[63] Continuation-in-part of Ser. No. 772,070, Feb. 25, 1977, abandoned.

[51] Int. Cl.[2] ..... B43K 1/08; B43K 7/12

[52] U.S. Cl. ..... 401/214; 401/216

[58] Field of Search ..... 401/190, 188 R, 188 A, 401/209, 212, 214, 216, 213

[56] References Cited

U.S. PATENT DOCUMENTS

| | | | |
|---|---|---|---|
| 1,951,057 | 3/1934 | Leitch | 401/188 A |
| 2,113,695 | 4/1938 | Krannak | 401/214 |
| 2,122,580 | 7/1938 | Morris | 401/214 |
| 2,644,613 | 7/1953 | Pepin | 401/214 X |
| 2,787,249 | 4/1957 | Barlow et al. | 401/188 A |
| 2,834,321 | 5/1958 | Duefrene | 401/216 |
| 2,930,062 | 3/1960 | Reimann | 401/214 |
| 3,000,355 | 9/1961 | Rosenthal | 401/214 X |
| 3,425,779 | 2/1969 | Fisher et al. | 401/190 |
| 3,792,932 | 2/1974 | Henriksen | 401/188 X |
| 3,819,285 | 6/1974 | Andrews et al. | 401/214 X |
| 3,854,826 | 12/1974 | Adams | 401/188 A |

FOREIGN PATENT DOCUMENTS

| | | | |
|---|---|---|---|
| 697595 | 10/1940 | Fed. Rep. of Germany | 401/214 |
| 974792 | 10/1950 | France | 401/214 |
| 1136563 | 12/1956 | France | 401/214 |
| 1137937 | 6/1957 | France | 401/214 |

*Primary Examiner*—Edgar S. Burr
*Assistant Examiner*—Steven A. Bratlie
*Attorney, Agent, or Firm*—Eliot S. Gerber

[57] ABSTRACT

A marking pen comprises a hollow cylindrical ink reservoir and a removable writing tip. It may also include a pressure means which, upon hand actuation, applies pressure to the viscous ink within the reservoir. The writing tip (nozzle) is a hollow plastic member having an internal flange to position a spring and means to hold a hollow cylindrical metal member. The spring is held between the flange and a ball, the ball partly protruding from the orifice of the inwardly flanged valve-type seat of the metal member.

7 Claims, 8 Drawing Figures

MARKING PEN WRITING TIP

BACKGROUND OF THE INVENTION

This application is a continuation-in-part of pending prior application Ser. No. 772,070, filed Feb. 25, 1977 and entitled "Marking Pen Writing Tip," now abandoned.

The present invention relates to pens and more particularly to the writing tip used in a marking pen.

A marking pen, as distinguished from other types of writing implements, may be characterized by the type of ink which it utilizes, the ink being in the form of thick, viscous fluid, for example, of about 5000 centipoise. At the present time marking pens are generally used in industrial applications for the marking of textiles and other products and may be used in non-industrial applications for decorating cloth. The ink is spread in a relatively thick line and may be "indelible," i.e., resistant to ordinary cleaning methods, when used to mark cloth. The ink may be produced in a wide variety of colors. The marking pens of this type may use a spring-loaded ball writing tip to spread the ink on the surface, although the ball may be relatively large when compared to the ball used in conventional ball point pens. The ball, in addition to acting as the spreading device when it rolls, also acts as part of a seat-type ball valve for the viscous ink. The ball, of steel or other hard metal, sits in a steel or other metal seat and is pressed against the valve-type seat by a spring. The writing tip comprises a metal member which encloses the ball and the spring. The writing tip is screwed or otherwise fastened to an ink reservoir which may, for example, be an elongated aluminum tube. A pressure means, for example, an air pump mechanism, may be positioned at the end of the tube reservoir opposite to the writing tip and may be used to apply pressure to the ink within the tube to cause the ink to flow.

This type of marking pen writing implement has been widely accepted for industrial uses and for non-industrial decorative uses in connection with the decoration of cloth. However, generally the writing instrument tip is relatively expensive to produce as it requires relatively accurate machining of metal and a relatively complicated shape. In addition, the assembly operation may be performed by hand since the metal enclosing member of the tip and its spring and ball are all separate members requiring an assembly operation before they are assembled together with the case.

Sometimes it is desirable for the user to replace the tip (nozzle) of the writing instrument. For example, the writing tip (nozzle) may become damaged or he may wish to use a different size of nozzle. However, such replacement may prove to be difficult using some presently employed types of writing tips. The parts, such as the ball and spring, of such writing tips are small, separate and loose. Those small parts are easily lost or misplaced. It may be difficult for the user to reassemble those small parts in order to replace the nozzle.

It has been suggested that a one-piece writing tip may be molded from a suitable plastic and used to retain a metal ball and spring. However, even if the plastic of the tip is selected to be wear-resistant, it generally would be unsuitable for industrial applications, such as writing on abrasive surfaces, since the plastic tip would wear out before the ink was exhausted.

Various U.S. patents have suggested a two-piece spring-loaded ball writing tip. In U.S. Pat. No. 2,930,062 a steel tube 19 is held within an orifice 18 of "brass or aluminum" (col. 2, line 25) and the end is staked for forming abutments 24. In U.S. Pat. No. 3,166,618 a ball is held by a thermoplastic nib which is filled with copper beads or other spherical fillers. In U.S. Pat. No. 2,660,151 a ball is held in a writing tip portion 11 having a metal shell 24. In U.S. Pat. No. 2,823,403 a ball for liquid deodorants and the like is held by an elastic fitment. In U.S. Pat. No. 3,048,148 a ball in a ball point pen is held by a plastic resin socket, the socket being held by a metal ferrule.

SUMMARY OF THE INVENTION

In accordance with the present invention a marking pen writing implement is provided which uses a tubular casing as its ink reservoir for the viscous ink. In some instances the tubular casing may have a pressure means such as an air pump utilizing a dome-shaped resilient member having an orifice at its top. When the user's finger is placed over the orifice and the dome squeezed (depressed), the air within the dome is forced through a one-way valve positioned at the bottom of the dome, causing a rise in air pressure within the tubular casing.

A writing tip is provided at the bottom end of the pen, for example, the opposite end of the tubular casing from the air pump mechanism, in those pens using that type of pressure means. The writing tip is a separate unitary module which, after being assembled, will not come apart in normal usage. The writing tip comprises a hollow plastic resin member having an upper cavity, an inwardly projecting ring-shaped flange (shelf), and a lower cavity. The upper cavity has internal screw threads which mesh with the screw threads on the neck of the tubular ink reservoir casing. The lower cavity has an internal right cylinder wall and is adapted to receive and hold a metal cylinder tip member. Alternatively, the lower cavity may have an external right cylinder wall to hold the tip member. The metal cylindrical tip member is hollow and at its lower end has an orifice which is smaller in diameter than the diameter of a ball and is the valve seat for the ball. In one embodiment the valve seat is formed by the rounded side walls of the inwardly flanged nose of the metal tip member and the valve seat is preferably slightly recessed from the nose. In all of the embodiments the ball is held against the valve seat by a spring which is held under compression between the top of the ball and the lower face of the internal flange of the plastic resin member. The metal tip member and the ball and the spring are assembled together with the plastic resin member to form the assembled writing tip module, and the writing tip module is then assembled to the tubular casing.

OBJECTIVES AND FEATURES OF THE INVENTION

It is an objective of the present invention to provide a writing tip that combines the cost and sealing advantages of a plastic resin member and the ball retaining strength and wear resistance of a steel member.

It is a further objective of the present invention to provide a marking pen in which the writing tip may be removed from the ink reservoir casing and in which the writing tip is a self-contained unitary module containing a writing ball and a spring.

It is a further objective of the present invention to provide a writing tip that may be produced in mass production at relatively low cost and which may be assembled using automatic machinery.

It is a further objective of the present invention to provide various embodiments of such marking pens having a valve seat for the ball formed by the rounded side walls of the inwardly flanged nose. This tip is consequently relatively smooth, so it will not injure material being marked and recessed and less susceptible to damage. Its double wall provides increased strength and a smooth valve seat for the ball.

It is a further objective of the present invention to provide a writing tip for a marking pen which may be assembled as a complete unit with its spring and ball held in position and then assembled onto the casing of the pen.

It is a feature of the present invention to provide a marking pen comprising an elongated tubular casing, for example, of aluminum, which forms an ink reservoir. The ink reservoir may be provided with a pressure means, for example, a flexible dome and a one-way air valve, which, upon hand actuation, raises the pressure within the casing. A writing tip module is connected to the reservoir to receive ink from the reservoir and spread the ink on a surface. The writing tip module includes a ball, a spring which spring-loads the ball, and a holder which holds said ball and spring. The holder comprises a joined metal writing tip and a plastic member, the plastic member being of a synthetic plastic resin and being a hollow cylindrical member having an internal shelf means to support one end of the spring, and connection means to secure the plastic member to the casing. The metal tip member is a metal hollow cylindrical member which is a formed sheet metal member secured, for example, by a friction fit, in the plastic member. In some embodiments the metal tip member has an inwardly flanged, turned-back and recessed valve seat for the ball. A portion of the ball protrudes through the orifice formed by the valve seat of the metal tip member.

BRIEF DESCRIPTION OF THE DRAWINGS

Other objectives and features of the present invention will be apparent from detailed description providing the inventor's best mode of practicing the present invention. The detailed description should be taken in conjunction with the accompanying drawings, in which.

DETAILED DESCRIPTION OF THE INVENTION

Figure 1:
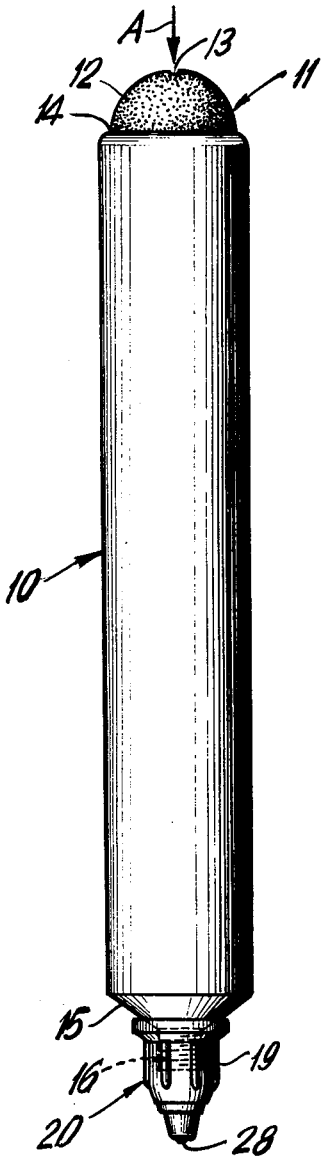
FIG. 1 is a side plan view of the marking pen of the present invention.

As shown in FIG. 1, the marking pen of the present invention includes an elongated tubular casing 10, which, for example, is an aluminum right circular cylinder. The casing 10 has a pumping mechanism 11 at one of its ends. The pumping mechanism 11 includes a flexible dome 12 which may be, for example, molded of rubber or a suitable flexible plastic material. The dome 12 is a hollow member and has a small orifice 13 at the center of its top. The dome has a flange (not shown) which is held under the inwardly directed flange 14 of the casing 10. A one-way valve (not shown) at the bottom of the dome, for example, at the level of the flange 14, permits entry of air to the interior of the casing 10 but does not permit escape of air from the casing 10.

The user, to start the flow of the viscous ink, closes the orifice 13 and pushes downardly on the dome in the direction of the arrow A, squeezing and collapsing the dome. The collapse of the dome will force the air which had been within the dome through the one-way valve and into the casing 10, raising the air pressure within the casing and causing the viscous ink to flow. The casing 10, at its opposite lower end, has a tapered inwardly directed wall 15 and a neck portion 16. The neck 16 is a right circular cylinder having external screw threads. The writing tip 20 is screwed onto the neck 16.

Figure 2:
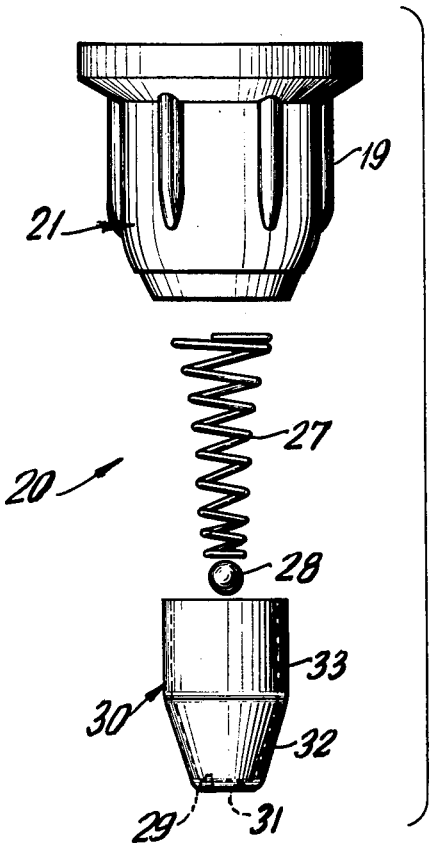
FIG. 2 is an enlarged side plan view of the disassembled parts constituting the writing tip of the marking pen of FIG. 1.
Figure 3:
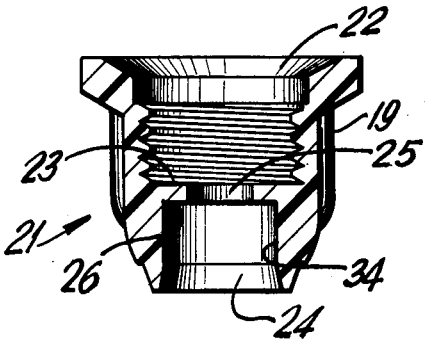
FIG. 3 is an enlarged cross-sectional view of the plastic resin member of the writing tip of FIG. 2.

As shown in FIGS. 2 and 3, the writing tip 20 is a unitary module and includes a plastic resin member 21 of a suitable injection-molded plastic, for example, nylon. The plastic member 21 is a hollow member having an upper cavity 22, a ring-like inwardly directed flange (shelf) 23, and a lower cavity 24. The upper cavity 22 has internal screw threads which screw onto the exterior screw threads of the neck portion 16. The external ribs 19 of member 21 provide stiffening and a gripping means to unscrew the writing tip. The flange 23 forms an internal hole 25 for the passage of the viscous ink and provides at its lower face 26 a seat for one end of a helical spring 27. The helical spring 27, at its lower end, pushes against a metal ball 28 which may be, for example, of stainless steel, and the ball sits in a recessed valve seat 31 formed by the metal tip member 30. The metal tip member 30 is preferably stamped, or otherwise formed, from sheet metal and is preferably of stainless steel. The metal member 30 has an inwardly flanged nose 29 which forms a recessed valve seat 31 and a bottom orifice whose diameter is less than the diameter of the ball 28.

The particular metal tip member illustrated in FIG. 2 has a tapered lower section 32 and a generally right cylindrical upper section 33. The upper section 33 of the metal member 30 is press-fitted into the cavity 24 and is held there by the right cylindrical inner wall 34 of the plastic resin member 21.

Figure 4:
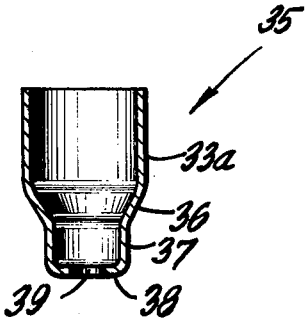
FIG. 4 is an enlarged cross-sectional view of one embodiment of a metal tip member used in the writing tip of FIG. 2.

The metal tip member 35, illustrated in FIG. 4, has a right cylindrical upper section 33*a*, a cylindrical taper 36, a right cylindrical lower section 37 and an inwardly flanged nose 38 forming orifice 39.

The writing tip illustrated in FIGS. 2 and 4 is particularly well adapted for small sizes. In those cases the sheet metal shell is relatively thick and strong compared to the ball. For example, a small writing tip may be used with a ball of 0.0002 inch. However, the larger size writing tips may be damaged if dropped. The embodiments described below strengthen the writing tip at the valve seat by rolling over the end of the metal tip member to form an orifice. The valve seat is formed by compression, either by a tool or by compression through the ball.

Figure 8:
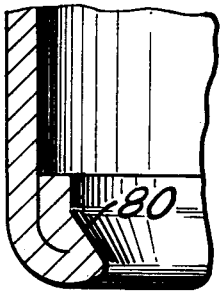
FIG. 8 is an enlarged cross-sectional view of one-half of the nose portion of a metal tip member of one embodiment of the present invention.

The double thickness metal at the orifice presents distinct advantages. First, it presents a smooth end to the material being marked. This is especially important in the case of marking upon cloth. Secondly, a smooth seat is formed for the ball. If desired, an internal bevel 80 may be formed, as shown in FIG. 8, to obtain the valve seat. Thirdly, the double thickness of metal provides increased strength at the valve seal and the end of the tip.

Figure 5:
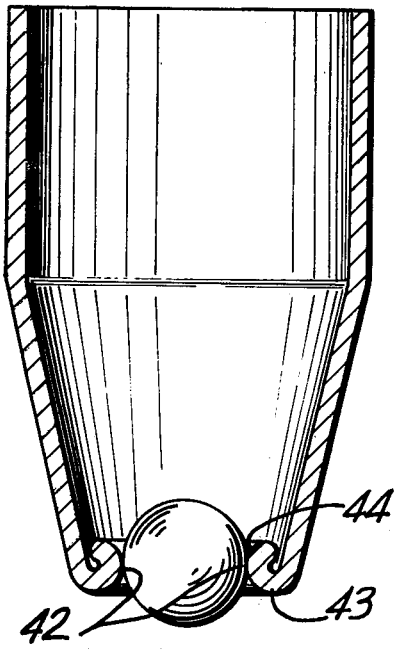
FIGS. 5, 6 and 7 are enlarged views, partly in cross-section, of alternative metal tip members which may be used in the writing tip of FIG. 2.

A cross-sectional view of an alternative metal tip member is shown in FIG. 5. The nose 43 of the metal member is inwardly flanged to form flange 42 and the recessed valve seat 44. The ball 28 will contact the rounded side portion of these walls at valve seat 44, closing the valve in the absence of pressure on the bottom end of the ball. The inward flange 42 forms a smooth and strong support for the ball.

The flange 42 and recessed valve seat 44 may be formed by a series of automatic press operations, for example, by progressive forming. The valve seat may be made by a tool and the tips smoothed by tumbling or, alternatively, the ball may be pressed to form the seat. The ball would be of harder metal than the sheet metal.

Figure 6:
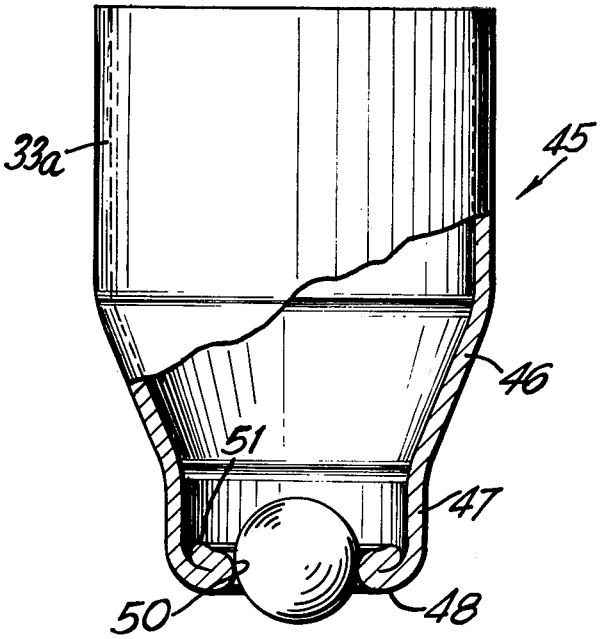

A still further alternative metal tip member 45 is illustrated in FIG. 6. In that metal tip member 45, which is a hollow cylinder, the upper portion 33*a* is of the same shape, i.e., a right cylindrical tube, as the upper portion 33 of the metal tip member 30. However, in the metal tip member 45 shown in FIG. 6, the bottom portion has an inwardly sloping tapered portion 46 which meets a lower tubular portion 47. The lower tubular portion 47 has an inwardly flanged nose 48 which forms a smooth-walled recessed valve seat 50. The flange portion at nose 48 is turned back to form a ring 51 having a double thickness of metal.

Figure 7:
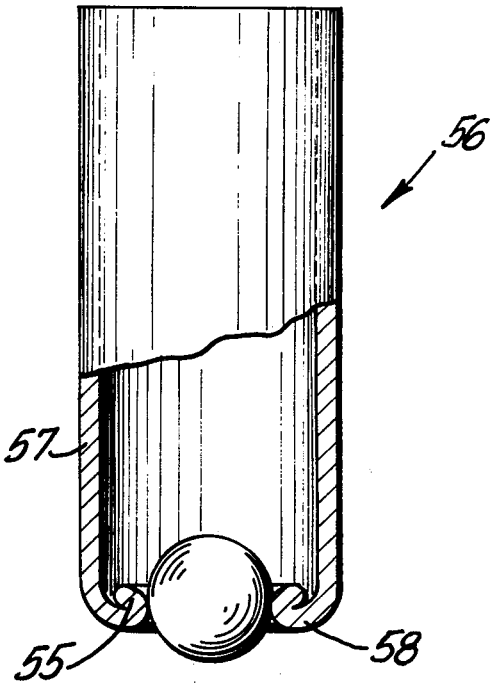

In the metal tip member 56 shown in FIG. 7 the tip conconsists of a tubular hollow right cylinder 57 having a flanged nose 58 whose flange portion is turned back onto itself, forming a double-walled ring 55.

The particular pressure means to raise the pressure within the reservoir described in connection with the embodiment of FIGS. 1–4 utilizes a flexible dome and a one-way air valve. Alternatively, other types of "pressure means," as that term is used herein, may be utilized. For example, the viscous ink may be contained within a flexible bag within the reservoir and a handle rotated to twist the top of the bag, thereby exerting pressure on the ink. As still another example, the casing may be of a flexible material and form a collapsible tube, which is compressed or rolled by the user, to apply pressure to the viscous ink. Suitable collapsible tubes have been made of tin, aluminum and lamination layers of plastic resin film. Also, the pressure may come from a suitable compressed gas such as Freon (trademark of DuPont) which may apply pressure to the ink without escaping through the ball valve.

The term "viscous ink," as used in the description and claims, means an ink which is a paste having a viscosity, preferably about 5000 centipoise and, in any event, in the range of 1200 to 10,000 centipoise. That viscosity range is specified as being preferably measured by a Brookfield RUT instrument at 100 r.p.m. with a No. 5 or No. 6 spindle.

It should be noted that the specified range of 1200–10,000 centipoise is a relatively narrow range of viscosity since viscosity is measured on a logarithmic scale.

Modifications may be made in the present invention within the scope of the subjoined claims. For example, the term "liquid" includes both marking ink and a liquid adhesive, and the term "marking pen" refers to pens which apply such liquids.

What is claimed is:

1. A marking pen comprising:

a casing forming a liquid reservoir and having viscous liquid therein, said liquid being in the viscosity range of 1200 to 10,000 centipoise, a writing tip module connected to said reservoir to receive said viscous liquid from said reservoir and spread the liquid on a surface, said writing tip module including a ball, a spring which spring-loads said ball, and a holder which holds said ball and spring, characterized in that said holder comprises a plastic member and a metal tip member, said plastic member being of a synthetic plastic resin and being a hollow cylindrical member having an internal bore and having an internal means protruding into said bore and supporting one end of said spring, the other end of said spring being against said ball, said plastic member having connection means to secure said plastic member to said casing, said metal tip member being a metal hollow cylindrical member which is a formed sheet metal member and which is fastened to said plastic member, said metal tip member having a valve seat for said ball forming an orifice through which a portion of said ball protrudes;

said valve seat being formed by a turned-back portion of said sheet metal member to form a strong and smooth valve seat for said ball; said spring normally compressing said ball against said valve seat to seal said marking pen, during operation of said pen said ball pushing against said spring to become unseated from said valve seat and permitting flow of said liquid through said orifice.

2. A marking pen as in claim 1 and further including a pressure means connected to said reservoir which upon actuation will raise the pressure on said liquid within said reservoir.

3. A marking pen as in claim 2 wherein said pressure means includes a flexible dome-shaped bulb member and a one-way air valve.

4. A marking pen as in claim 3 wherein the bore of said plastic member forms a lower cavity having an internal wall which is a right-sided cylinder and said metal member has an upper cylindrical portion secured in said lower cavity by a frictional fit.

5. A marking pen as in claim 1 wherein the said connection means for connection of said plastic member and said casing comprises that said bore forms an upper interior cavity of said plastic member having screw threads which mesh with screw threads on said casing.

6. A marking pen as in claim 5 wherein said protruding means of said plastic member is in the shape of a ring and separates its upper and lower cavities.

7. A marking pen as in claim 1 wherein said casing has a tubular metal body portion which is an elongated hollow right-sided cylinder.

* * * * *